United States Patent [19]

Husa

[11] 4,325,353

[45] Apr. 20, 1982

[54] HEATING APPARATUS

[76] Inventor: Marlin V. Husa, Liberty, Nebr. 68381

[21] Appl. No.: 146,007

[22] Filed: May 2, 1980

[51] Int. Cl.[3] ..... F24B 7/00

[52] U.S. Cl. ..... 126/121; 126/131; 126/307 R; 98/46; 237/55; 237/51

[58] Field of Search ..... 126/120, 121, 126, 123, 126/131, 164, 165, 307 R; 237/51, 55; 98/46

[56] References Cited

U.S. PATENT DOCUMENTS

| | | | |
|---|---|---|---|
| 3,896,785 | 7/1975 | Nelson | 126/131 |
| 4,064,864 | 12/1977 | Husa | 126/121 |
| 4,160,524 | 7/1979 | Stiber | 126/121 |

*Primary Examiner*—James C. Yeung
*Attorney, Agent, or Firm*—William D. West

[57] ABSTRACT

An apparatus for the heating of ambient air within enclosed chambers in the walls of a fireplace, providing a more efficient means of utilizing the heat radiation produced by a fireplace and also to provide fresh warm air for heating purposes throughout a home is disclosed.

Cold ambient temperature air is forced into the system by a two-speed fan through a cold air conduit into the outer chamber of the fireplace apparatus. The air is forced up the outer chamber to the top of the chimney where it crosses over to the inner heating chamber and the diagonal duct located within the flue space of the chimney. As the air progresses down the inner warm air passageway and the diagonal flue duct, it is heated by conduction through a metal wall in contact with the hot gases produced by the fire. The air then is forced down through these passageways into the rear and sides of the firebox. The air is fed thorugh a manifold grating under the fire, and then collected in the hot air plenum located at the base of the firebox. The thoroughly warm air is then forced out an exit conduit into an existing furnace heat plenum for distribution throughout the house.

12 Claims, 3 Drawing Figures

HEATING APPARATUS

BRIEF SUMMARY OF THE INVENTION

Figure 1:
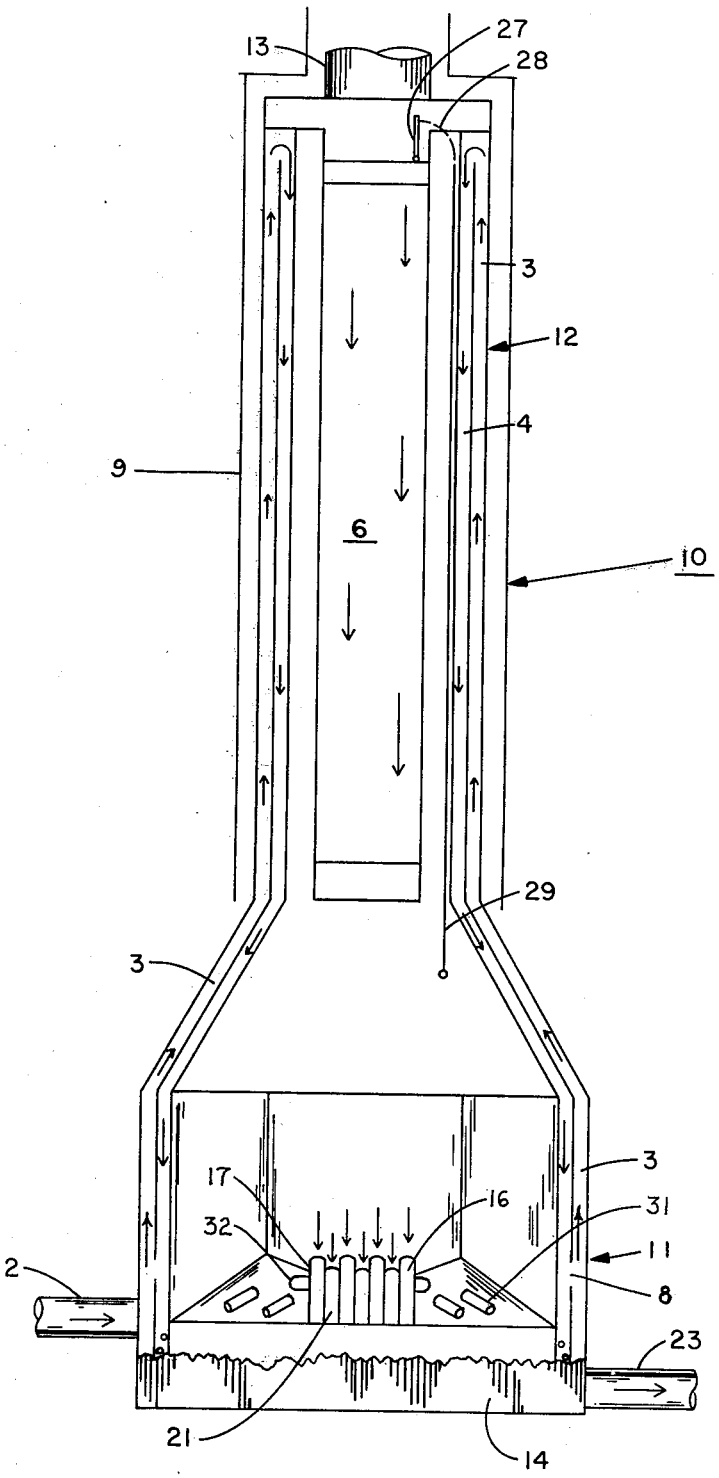

One of the objects of this invention is to provide an efficient means of heating ambient air using the operating characteristics of a fireplace.

Another object of this invention is to provide heated fresh air to a house by the use of inexpensive firewood.

Another object of this invention is to provide a heating apparatus whereby the hot air of the fire is never in contact with the air being heated, thus providing fresh oxygenated air to the household at all times.

Another object of this invention is to provide a forced air apparatus to supply air for heating.

Another object of the invention is to provide a conduction means via the slanted chimney flue diagonal duct with a large surface area thereby efficiently using the heat radiation of the fire.

Another object of the invention is to provide a regulated oxygen source to the fire.

Another object of the invention is to provide an air jet means for cleaning the inside surface of a glass partition.

Another object of the invention is to provide a manually controlled damper to increase or decrease the heat and gas radiation escaping through the chimney.

Another object of the invention is to provide a convenient means of collecting and disposing of ash residue.

Another object of the invention is to provide an outer shell insulating cover to prevent structural overheating and to facilitate insulation of the chimney structure.

Another object of the invention is to provide a prefabricated fireplace apparatus which may be installed in presently existing or newly built homes.

Another object of the invention is to provide a fireplace which utilizes wood fuel for home heating in addition to the already existing heating means.

Another object of this invention is to provide a heating apparatus which provides fresh heated air to a house by the use of either firewood, natural gas or a combination of firewood, natural gas or other heating fuels.

A further object of this invention is to provide a heating apparatus for heating a swimming pool and for drying clothes.

A still further object of this invention is to provide a heating apparatus whereby water for household use can be preheated within a water jacket structure adjacent the fireplace heat chamber.

A further object is to provide a heating apparatus with draft regulation and spark arrest.

It is a still further object of this invention to provide a heating apparatus which may double as a grate in a fireplace.

The foregoing objects still and others are accomplished in accordance with this invention by providing an apparatus for the heating of fresh ambient air by a fireplace in enclosed passageway. The air is forced up, then down, passageways between the walls of the firebox and chimney. Cool air is also forced into the diagonal duct traversing the inner space of the flue providing a large surface area for the conduction of heat radiation through the metal duct, thereby heating the air contained therein. The air is then forced into a plurality of hollow pipes upon which the fire is built, thereby providing a heating mechanism for the air. The air is then forced into a hot air plenum at the base of the firebox via the orifices in the inner wall on either side of the firebox and the manifold grating system. The hot air that is collected in the plenum is then forced into an existing furnace heat plenum for distribution throughout the house as needed or as thermostatically controlled. The cold air is forced or pulled in by a fan positioned in a conduit such that all of the air is selectively pulled in from the outside being fresh and oxygenated, or from the cold air return, thereby providing the household with fresh heated air at all times. The apparatus also creates a positive pressure in the interior of the heating space.

DESCRIPTIVE EMBODIMENTS

Figure 3:
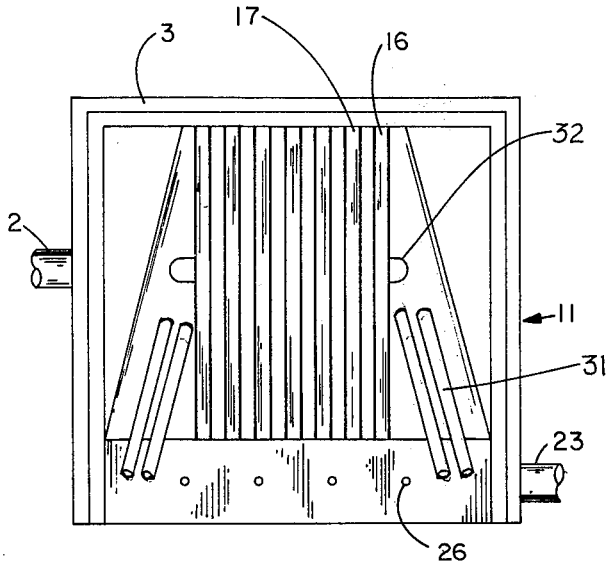
Figure 2:
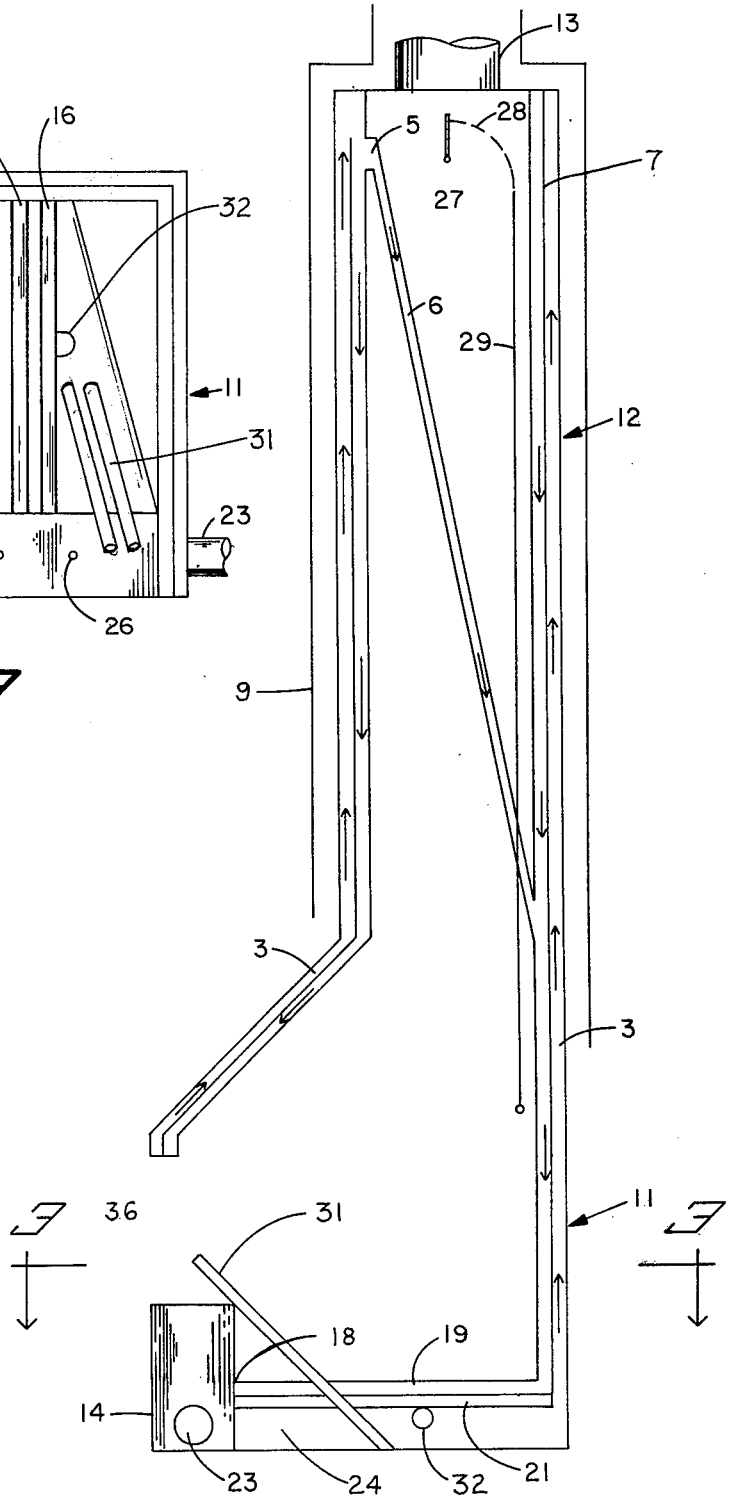

The apparatus described below is an improvement on the concept of fireplace adaptability to be used for heating homes. More specifically, as can be seen in FIG. 1, the invention is depicted generally at 10. Cold ambient air is forced into the enclosed cold air conduit 2 by a two-speed "high flow" fan (not shown) situated below the floor joist such as in the basement. The high-low fan is thermostatically controlled by the house temperature. The thermostat engages the fan which causes outside fresh ambient air to be drawn through a filter (not shown) then forced through the cold air conduit 2. A cold air passageway 3 encompasses the back and sides of the firebox 11 and surrounds the chimney space 12 on all sides as shown in FIGS. 1 and 3. The pressure created by the fan causes cold air to flow up the outer passageway 3 to the top of the chimney 12 where it is then redirected downward into the passageway 4, and by the cross over space 5, as shown in FIG. 2, into the diagonal duct 6, which partially traverses the interior of the chimney space 12. The outer passageway 3 and passageway 4 are separated by a sheet metal wall 7. Heated air from passageway 3 is bled through holes 8, located in the lower portion of the sheet metal wall 7, into inner passageway 4 to increase heating efficiency and to improve the air flow characteristics of the system. The air is heated in passageways 3, 4 and 6 by conduction from the sheet metal wall 7 which is in fluid communication with the heat reduction and gases; thus increasing the heating efficiency of the apparatus 10. It is also apparent that conduit 6 acts as a sparker arrester to prevent heat fluctuation due to the effect of wind strength on the chimney stack 13.

Passageway 3 and passageway 4 encompass the back and sides of the firebox and all sides of the chimney. The warm air in passageway 4 is forced downward and enters the hot air plenum 14 via the manifold grating 16. The manifold grating 16 comprises two rows of a plurality of hollow metal pipes 17 attached to the inner rear wall of the firebox 11 and the rear partition 18 of the hot air plenum 14. One group of pipes 19 is operably disposed above the other 21, so as to comprise one row 19 above a second row 21. The pipes in the lower row are operably disposed so as to align with the spaces between the upper pipes. Hot air is collected at the rear of the firebox from passageway 4, mixes with warm air from the diagonal conduit 6 as shown in FIG. 2. Hot air then is forced through manifold grating 16 and into hot air plenum 14. The hot air plenum 14 extends upward in front of the firebox to provide an enlarged space for accepting and redirecting the heated air. A sufficiently large air space is necessary to produce proper air flow through the plenum 14. The hot air plenum 14, when heated, also serves as a stove. Hot air is then forced out via exit 23 into furnace heat plenum (not shown) and distributed throughout the house as needed.

The air being heated never comes in fluid contact with exhaust fumes from the fire; hence, the air is always fresh. The enclosed system also results in oxygenation of the home, eliminating stagnant conditions and creating a positive pressure within the house.

FIG. 2 shows that hot air plenum 14 provides jet port 24 tapped into its rear partition 18. Ports 24 provide oxygen to the fire proportionate to the heat demand of the house. When the fan functions on high, pressure is increased, causing more air to be forced into the apparatus 10 feeding oxygen to the fire via ports 24, thereby increasing its heat output. When the fan functions on the low setting, less air is forced through and hence, less oxygen fed to the fire, decreasing its intensity. Similarly, the upper partition base ports 26 function in an identical manner. When pressure increases, warm air is jetted out ports 26 directed against the inner surface of a glass partition preventing accumulation of soot on the partition. Decrease in pressure causes less air to be blown against the partition.

It can be seen from FIG. 2 that a plurality of safety grates 31 are rigidly attached to the upper surface of the hot air plenum 14 and the firebox 11 floor. The grates 31 thus attached extend a few inches above the hot air plenum 14 and incline toward the interior of the firebox 11. Any log rolling out from a burning woodpile will be restrained by the safety grate 31 and directed back into the firebox 11.

It must be noted that the firebox 11 is provided with the hot air plenum 14 in a manner so as to create a thermal action firebox which acts to draw additional air through opening 36. When the fire is of a high heat, the additional air travels immediately upward through the chimney 12. When the fire is of a lower heat, the additional air is not pushed upward and instead travels over hot air plenum 14 and safety grates 31 and downward to feed the fire placed on top of pipes 19. Thus, the firebox 11 is self regulating in that the additional air is only provided to the fire if the heat is reduced.

A gas burner 32 positioned below the manifold grating 16 allows logs to be ignited quickly without the use of kindling or starter fluid.

A heat shield 9 shown in FIGS. 1 and 2, surrounds the chimney and prevents overheating of objects or structural materials located near the chimney. A small air gap between the heat shield 9 and the chimney has an opening at the bottom and an opening at the top which allows gases in the air gap to vent into the atmosphere. Once the chimney is heated warm air convection will cause an upward flow of air in the air gap created by the heat shield 9. Combustion gases which might escape from air leaks in the chimney are therefore prevented from entering the room.

FIG. 1 also shows a damper 27 with connecting chain 28 and rod 29 which is attached to a manual damper control (not shown) protruding out the front of the fireplace. Damper 27 is an 80% damper, such that in its completely closed position only 80% of the chimney space is restricted, thus always permitting fumes and exhaust to escape via the remaining 20% opening. It should be noted that forced air heating apparatus 10 herein described operates independently from the fireplace and damper system. The natural draft of the fireplace and the heat of combustion are sufficient to carry the exhaust gases up the chimney. The fireplace can therefore be used whether or not the heating apparatus is in operation. Damper 27 is connected to metal rod 29. Said rod 27 passes down the chimney flue into the space immediately above the firebox 11. The rod 29 is bent at a slight angle and attached to a chain (not shown) which passes through an adjustable telescoping conduit to the exterior of the fireplace through any brick or other ornamental frontpiece. The chain is attached to a handle or grip on the exterior of the fireplace with a locking mechanism for control of the damper opening. The locking mechanism may be a V-shaped latch or lock situated so that any link in the chain may be locked to control the opening of damper 27. Damper 27 is normally in the full open position by gravity and requires manipulation of the damper control for closure to the desired amount.

Obviously, many modifications and variations of the described invention are possible. It is, therefore, understood within the scope of the appended claims, the invention may be practiced otherwise than as specifically described.

I claim:

1. An improvement in heating apparatus of a type having a firebox in fluid communication with a chimney wherein the improvement comprises:

(a) Updraft passageways surrounding the firebox;

(b) Downdraft passageways surrounding the firebox wherein the downdraft passageways are in fluid communication with the updraft passageways;

(c) A diagonal downdraft duct transversing the interior of the chimney space, in fluid communication with said updraft and downdraft passageways;

(d) A front manifold in communication with said downdraft passageways;

(e) Inlet means wherein unheated air is introduced into the updraft passageways;

(f) Exit means wherein said exit means are in fluid communication with said front manifold means;

(g) An exhaust chimney wherein said updraft passageways and said downdraft passageways extend into said chimney; and (h) Forced air means for forcibly moving air through the inlet means, the updraft passageways, the downdraft passageways, the diagonal downdraft duct, the front manifold, and the exit means.

2. The improvement in heating apparatuses as described in claim 1, wherein said diagonal duct is essentially comprised of sheet metal through which heat can pass.

3. The improvement in heating apparatuses as described in claim 1, further comprising a damper means operably disposed with said exhaust chimney wherein said damper means partially restrict said exhaust chimney.

4. The improvement in heating apparatuses as described in claim 1, further comprising a valve means for controlling the introduction of air into the inlet means.

5. The improvement in heating apparatuses as described in claim 4, further comprising a two-position thermostatically controlled means operably connected to the firebox.

6. The improvement in heating apparatuses as described in claim 1, further comprising a first plurality of air jets within the front manifold for supplying air to the firebox.

7. The improvement in heating apparatuses as described in claim 1, further comprising a partition means for sealing the firebox from ambient air.

8. The improvement in heating apparatuses as described in claim 1, further comprising a second plurality of jets within said front manifold means for directing heated air upon said partition means.

9. An improvement in heating apparatuses of a type having a firebox in fluid communication with a chimney wherein the improvement comprises:

(a) Updraft passage ways surrounding the firebox;

(b) Downdraft passageways surrounding the firebox wherein the downdraft passageways are in fluid communication with the updraft passageways;

(c) A front manifold in fluid communication with said downdraft passageways;

(d) A diagonal downdraft duct traversing the interior of the chimney space, in fluid communication with said updraft and downdraft passageways;

(e) Inlet means wherein unheated air is introduced into the updraft passageways in fluid communication with the updraft passageways;

(f) Exit means wherein said exit means are in fluid communication with said from manifold means;

(g) An exhaust chimney wherein said updraft passageways and said downdraft passageways extend into said chimney;

(h) Forced air means for forcibly moving air through the inlet means, the updraft passageways, the downdraft passageways, the diagonal downdraft duct, the front manifold, and the exit means;

(i) A damper means operably disposed within said exhaust chimney wherein said damper means partially restrict said exhaust chimney;

(j) A valve means for controlling the introduction of air into the inlet means;

(k) A first plurality of air jets within the front manifold for supplying air to the firebox;

(l) A two-position thermostatically controlled means operably connected to said forced air means;

(m) A partition means for sealing the firebox from ambient air; and, (n) A second plurality of jets within said front manifold means for directing heated air upon said partition means.

10. The improvement in heating apparatuses as described in claim 9, further comprising an ash collection means operably disposed within said firebox.

11. The improvement in heating apparatuses as described in claim 10, further comprising a plurality of safety grates operably disposed within said firebox.

12. An improvement in heating apparatus of a type having a chimney wherein the improvement comprises:

(a) Updraft passageways surrounding the chimney;

(b) First downdraft passageways surrounding the chimney wherein the downdraft passageways are in fluid communication with the updraft passageways;

(c) Second downdraft passageways in fluid communication between said first downdraft passageways;

(d) A diagonal downdraft duct traversing the interior of the chimney space, in fluid communication between said downdraft and said updraft passageways;

(e) Inlet means wherein unheated air is introduced into the updraft passageways in fluid communication with the updraft passageways;

(f) Exit means wherein said exit means are in fluid communication with said downdraft passageways; and (g) Forced air means for forcibly moving air through the inlet means, the updraft passageways, the first downdraft passageways, the second downdraft passageways, the diagonal downdraft duct and the exit means.

* * * * *